US007960084B2

(12) United States Patent
Koinuma et al.

(10) Patent No.: US 7,960,084 B2
(45) Date of Patent: Jun. 14, 2011

(54) METHOD OF PREPARING INFORMATION RECORDING MEDIUM

(75) Inventors: Nobuyuki Koinuma, Yokohama (JP); Mikio Ishibashi, Yokohama (JP); Kazuhisa Sudo, Kawasaki (JP); Megumi Ohtoshi, Kawasaki (JP); Reki Nakamura, Sagamihara (JP); Masafumi Yamada, Kawasaki (JP); Yukiko Iwasaki, Yokohama (JP); Takashi Sakamaki, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 833 days.

(21) Appl. No.: 11/925,266

(22) Filed: Oct. 26, 2007

(65) Prior Publication Data

US 2008/0102392 A1 May 1, 2008

(30) Foreign Application Priority Data

Oct. 26, 2006 (JP) ..... 2006-291795

(51) Int. Cl.
*G03G 15/20* (2006.01)

(52) U.S. Cl. ..... 430/126.1; 430/10; 430/124.52; 430/124.51

(58) Field of Classification Search ..... 430/10, 430/124.5, 124.51, 124.52, 126.1, 120.2
See application file for complete search history.

(56) References Cited

U.S. PATENT DOCUMENTS 4,975,748 A 12/1990 Koinuma et al.
5,003,354 A 3/1991 Takamiya et al.
5,016,114 A 5/1991 Sakata et al.
5,270,783 A 12/1993 Bisaiji et al.
5,327,201 A * 7/1994 Coleman et al. ..... 430/124.5
5,394,231 A 2/1995 Sudo et al.
5,592,267 A 1/1997 Misago et al.
5,606,408 A 2/1997 Yano et al.
5,619,316 A 4/1997 Shoji et al.
5,638,158 A 6/1997 Sanpe et al.
5,659,843 A 8/1997 Takano et al.
5,759,727 A * 6/1998 Malhotra ..... 430/124.5
6,014,532 A 1/2000 Takeichi et al.
6,118,964 A 9/2000 Kojima et al.
6,337,957 B1 1/2002 Tamaki et al.
6,358,596 B1 * 3/2002 Mehta et al. ..... 428/172
6,360,065 B1 3/2002 Ishibashi et al.
6,393,241 B1 5/2002 Matsumoto et al.
6,468,637 B1 * 10/2002 Kwasny et al. ..... 428/201

(Continued)

FOREIGN PATENT DOCUMENTS

CN 1166624 A 12/1997

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

*Primary Examiner* — Christopher RoDee
(74) *Attorney, Agent, or Firm* — Oblon, Spivak, McClelland, Maier & Neustadt, L.L.P.

(57) ABSTRACT

An information recording medium includes a transparent recording member and a substantially non-transparent member. The transparent recording member has at least one transparent area and a concavo-convex pattern on a first surface thereof while bearing a reverse toner image on a second surface thereof. The substantially non-transparent member is formed on the second surface of the transparent recording member.

2 Claims, 2 Drawing Sheets

U.S. PATENT DOCUMENTS 6,470,161 B2 10/2002 Fujishiro et al.
6,501,913 B2 12/2002 Hattori et al.
6,505,022 B2 1/2003 Kosuge et al.
6,519,428 B1 2/2003 Ohtoshi et al.
6,522,855 B1 2/2003 Katoh et al.
6,529,704 B1 * 3/2003 Kurita et al. ..... 399/390
6,546,219 B2 4/2003 Sato et al.
6,591,077 B2 7/2003 Yanagisawa et al.
6,628,908 B2 9/2003 Matsumoto et al.
6,664,017 B1 * 12/2003 Patel et al. ..... 430/10
6,665,508 B2 12/2003 Sudo et al.
6,692,030 B1 * 2/2004 Phillips ..... 430/10
6,763,216 B2 7/2004 Ishibashi et al.
6,775,503 B2 8/2004 Hattori et al.
6,778,790 B2 8/2004 Yoshinaga et al.
6,778,797 B2 8/2004 Sato et al.
6,826,381 B2 11/2004 Muramatsu et al.
6,873,809 B2 3/2005 Amemiya et al.
7,027,747 B2 4/2006 Iwasaki et al.
7,043,182 B2 5/2006 Sakai et al.
7,130,558 B2 10/2006 Matsumoto et al.
7,130,567 B2 10/2006 Sudo et al.
7,158,742 B2 1/2007 Sudo et al.
7,177,555 B2 2/2007 Shu et al.
7,184,691 B2 2/2007 Kita et al.
7,209,687 B2 4/2007 Sudo et al.
7,212,773 B2 5/2007 Sudo et al.
7,272,342 B2 9/2007 Nagashima et al.
7,389,082 B2 * 6/2008 Okamoto ..... 430/124.52
7,858,279 B2 * 12/2010 Halfyard et al. ..... 430/126.1
2004/0091684 A1 * 5/2004 Matsuura et al. ..... 428/195.1
2005/0031374 A1 2/2005 Nagashima et al.
2005/0064156 A1 * 3/2005 Izutani et al. ..... 428/195.1
2005/0250038 A1 * 11/2005 McAneney et al. ..... 430/124
2006/0032581 A1 2/2006 Sato et al.
2006/0239701 A1 10/2006 Ishibashi
2007/0058998 A1 3/2007 Ishibashi
2007/0140747 A1 6/2007 Kita et al.
2007/0164505 A1 7/2007 Ishibashi et al.
2007/0201904 A1 8/2007 Sano et al.
2007/0201905 A1 8/2007 Sano et al.

FOREIGN PATENT DOCUMENTS

CN 1167316 A 12/1997
JP 5-249724 9/1993
JP 7-20767 1/1995
JP 7-172087 7/1995
JP 2003-191568 7/2003
JP 3515850 1/2004
JP 2004-90282 3/2004
JP 2004-110024 4/2004
JP 2005-219356 8/2005

* cited by examiner

METHOD OF PREPARING INFORMATION RECORDING MEDIUM

CROSS-REFERENCE TO RELATED APPLICATION

This application is based on and claims priority from Japanese Patent Application No. 2006-291795, filed on Oct. 26, 2006 in the Japan Patent Office, the entire contents of which are incorporated by reference herein.

BACKGROUND

1. Field of the Invention

Exemplary aspects of the present invention relate to an information recording medium, and more particularly, to an information recording medium having image information such as credit cards and ID cards that cannot be reproduced. In addition, the present invention also relates to a method of preparing the information recording medium.

2. Description of the Related Art

Information recording media having image information, for example, credit cards and ID cards, are often fraudulently reproduced. In attempting to solve such a problem, a variety of proposals have been made.

One approach attempts to form an image having a convex area with a printing ink and to cover the convex area with a transparent protective layer without damaging the image. However, this example needs a special toner and/or ink to form the convex area on the image surface by an image forming apparatus. Consequently, the image forming apparatus has to be specialized.

Another approach attempts to make a gloss difference on the surface of a toner image by fixing the toner image employing a fixing roller having a textured surface pattern. However, the gloss difference cannot be generated in a non-image area that has no toner image.

Still another approach attempts to adjust the degree of glossiness of a toner image by employing a heat roller having a concavo-convex surface. However, such a heat roller cannot control the degree of glossiness in a non-image area that has no toner image.

In addition, usage of a transparent sheet and a transparent medium are commonly known in the art. For example, a transparent sheet covers both sides of a printed sheet to protect the printed sheet from dirt and moisture. However, the transparent sheet can be removed from the printed sheet, allowing reproduction of the printed sheet. Further, a technique in which an image is formed on a transparent medium so as to observe the image through the transparent medium is proposed. Such a transparent medium can protect the image, but it is unlikely to reduce reproduction of the image.

SUMMARY

According to one aspect of the present invention, an information recording medium includes a transparent recording member and a substantially non-transparent member such as an opaque member and a translucent member. The transparent recording member has at least one transparent area and a concavo-convex pattern on a first surface thereof while bearing a reverse toner image on a second surface thereof. The substantially non-transparent member is formed on the second surface of the transparent recording member.

Another aspect of the present invention provides a method of preparing an information recording medium involving forming a reverse toner image on a second surface of a transparent recording member having at least one transparent area and a concavo-convex pattern on a first surface thereof; fixing the reverse toner image on the second surface of the transparent recording member; and forming a non-transparent member formed on the second surface of the transparent recording member.

BRIEF DESCRIPTION OF THE DRAWINGS

A more complete appreciation of the exemplary aspects of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
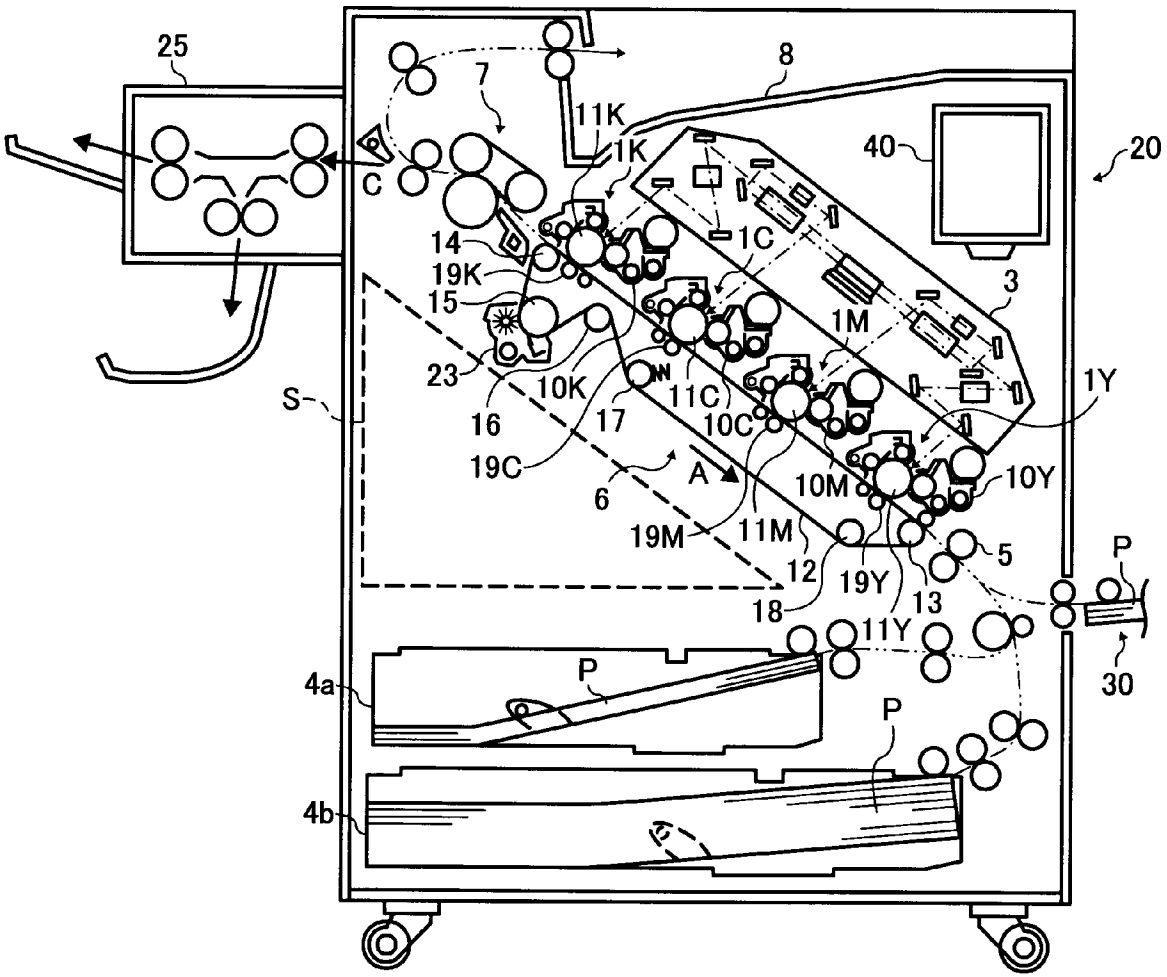
FIG. 1 is a schematic diagram illustrating an image forming apparatus used to describe an information recording medium of an exemplary embodiment of the present invention.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner.

Referring now to the drawings, wherein like reference numerals designate identical or corresponding parts throughout the several views thereof, an image forming apparatus forming an image on an information recording medium according to an exemplary embodiment of the present invention is described.

Referring to FIG. 1, an image forming apparatus 20 includes image forming units 1Y, 1M, 1C, and 1K, an optical writing unit 3, a transfer unit 6, a cleaning device 23, a fixing unit 7, an ejection tray 8, a first sheet feed cassette 4*a*, a second sheet feed cassette 4*b*, a manual tray 30, a toner container 40, registration rollers 5, primary transfer rollers 19Y, 19M, 19C, and 19K, and a post-processing device 25.

The image forming units 1Y, 1M, 1C, and 1K form images of four colors, yellow, magenta, cyan and black, respectively. The colors of yellow, magenta, cyan and black are abbreviated as Y, M, C and K, respectively, and the color abbreviations may be omitted as necessary. The sequential color arrangement of the image forming units 1Y, 1M, 1C, and 1K is not limited thereto. The image forming units 1Y, 1M, 1C, and 1K include photoconductor drums 11Y, 11M, 11C, and 11K as image carriers, respectively. As shown in FIG. 1, the image forming units 1Y, 1M, 1C, and 1K are disposed such that each rotation axis of photoconductor drums 11Y, 11M, 11C, and 11K is parallel to every other, with a certain distance interposed between adjacent units in a direction of movement of a transfer sheet (sheet movement direction).

As the image forming units 1Y, 1M, 1C, and 1K are substantially similar to one another except for the color of the toner, the image forming unit 1Y alone is described as representative of the image forming units 1Y, 1M, 1C, and 1K.

The image forming unit 1Y includes a charger, not shown, a cleaner, not shown, and a development device 10Y in addition to the photoconductor drum 1Y. The charger includes a charging roller, not shown, and uniformly charges a surface of the photoconductor drum 11Y. The photoconductor drum 11Y forms an electrostatic latent image thereon by a laser beam emitted from the optical writing unit 3. The cleaner removes a remaining toner from the surface of the photoconductor drum 11Y. The development device 10Y includes a development roller, not shown, a screw, not shown, and a toner density sensor, not shown, and uses a two-component developer including a toner and a carrier for a development process. The development roller faces the photoconductor drum 11Y and includes a rotatable sleeve located outside thereof and a magnet fixed to an inside thereof, thereby supplying the toner to the electrostatic latent image on the photoconductor drum 11Y. The screw conveys the two-component developer while agitating it. A toner supply device, not shown, supplies additional toner from a toner container 40 in response to output from the toner density sensor. Therefore, the development device 10Y develops the electrostatic latent image on the photoconductor drum 11Y with the two-component developer, and forms a toner image Y on the surface of the photoconductor drum 11Y. The development devices 10M, 10C and 10K of respective image forming units 1M, 1C, and 1K are similar to the development device 10Y of the image forming unit 1Y except for the toner colors.

The optical writing unit 3 is disposed above the image forming units 1Y, 1M, 1C, and 1K and includes a light source, not shown, a polygon mirror, not shown, a fθ lens, not shown, and a reflection mirror, not shown. The optical writing unit 3 writes the electrostatic latent image, for example, on the photoconductor drum 11Y with the laser beam that is formed based on image data.

The transfer unit 6 acting as a belt drive device is disposed below the image forming units 1Y, 1M, 1C, and 1K, and includes a transfer-conveyance belt 12 that is tightly stretched by a plurality of rollers such as a first roller 13, a second roller 14, a third roller 15, a fourth roller 16, a fifth roller 17, and a sixth roller 18. The transfer-conveyance belt 12 conveys a transfer sheet P fed from at least one of the first sheet cassette 4*a* and the second sheet cassette 4*b* such that the transfer sheet P passes a transfer area of the image forming unit 1Y, for example.

The cleaning device 23 includes a brush roller and a cleaning blade, and is disposed at an outer circumference surface of the transfer-conveyance belt 12. The cleaning device 23 removes a foreign substance including the toner from the transfer-conveyance belt 12.

The fixing unit 7 and the ejection tray 8 are disposed at a side of the transfer unit 6. The fixing unit 7 fixes the toner image on the transfer sheet P. The ejection tray 8 is on which the transfer sheet P is ejected. Each of the first sheet feed cassette 4*a* and the second sheet feed cassette 4*b* stores at least one transfer sheet P and is disposed in a lower portion of the image forming apparatus 20. The manual tray 30 is disposed at a side of the image forming apparatus 20 so that the transfer sheet P is supplied manually. The registration rollers 5 register the transfer sheet P. The primary transfer rollers 19Y, 19M, 19C, and 19K press respective photoconductor drums 11Y, 11M, 11C, and 11K with the transfer-conveyance belt 12 therebetween, thereby transferring the toner images on the photoconductor drums 11 onto the transfer sheet P conveyed by the transfer-conveyance belt 12.

In addition, an area S indicated by a dotted line includes a waste toner bottle, not shown, a double sides and reversal unit, not shown, and a power source unit, not shown. The post-processing device 25 will be described with reference to FIG. 2.

A description is now given of an image forming process by the image forming apparatus 20.

A power source, not shown, applies a predetermined voltage to each of the charging rollers. The chargers including the charging rollers uniformly charge respective surfaces of the photoconductor drums 11Y, 11M, 11C, and 11K. The optical writing unit 3 irradiates the surfaces of the photoconductor drums 11Y, 11M, 11C, and 11K with the laser beams so that the electrostatic latent images Y, M, C, K are formed on the respective photoconductor drums 11.

The development devices 10Y, 10M, 10C and 10K develop the electrostatic latent images Y, M, C and K on the respective photoconductor drums 11Y, 11M, 11C, and 11K with respective colors of toner by using the development rollers, thereby forming single toner images Y, M, C and K on the respective photoconductor drums 11Y, 11M, 11C, and 11K.

The transfer sheet P is fed from one of the first sheet feed cassette 4*a*, the second sheet feed cassette 4*b* and the manual tray 30, and is conveyed to the registration rollers 5. Upon reaching the registration rollers 5, the conveyance of the recording medium P halts. The registration rollers 5 rotate in sync with formation of the toner images Y, M, C and K, thereby feeding the recording sheet P.

The transfer-conveyance belt 12 conveys the transfer sheet P so that the toner images Y, M, C and K on respective photoconductor drums 11Y, 11M, 11K and 11K are sequentially transferred onto the transfer sheet P. Specifically, the power source applies a voltage having a polarity opposite to that of charge of the toner on the photoconductor drums 11. The voltage is subsequently applied to the photoconductor drums 11Y, 11M, 11C, and 11K through the transfer roller 19Y, 19M, 19C, and 19K, thereby sequentially transferring the toner images Y, M, C and K on respective photoconductor drums 11Y, 11M, 11C, and 11K onto the transfer sheet P while overlaid, thus forming a full color toner image on the transfer sheet P.

The transfer sheet P having the full color toner image thereon is conveyed to the fixing unit 7. Subsequently, the fixing unit 7 applies heat and pressure to fix the full color toner image on the recording sheet P.

Figure 2:
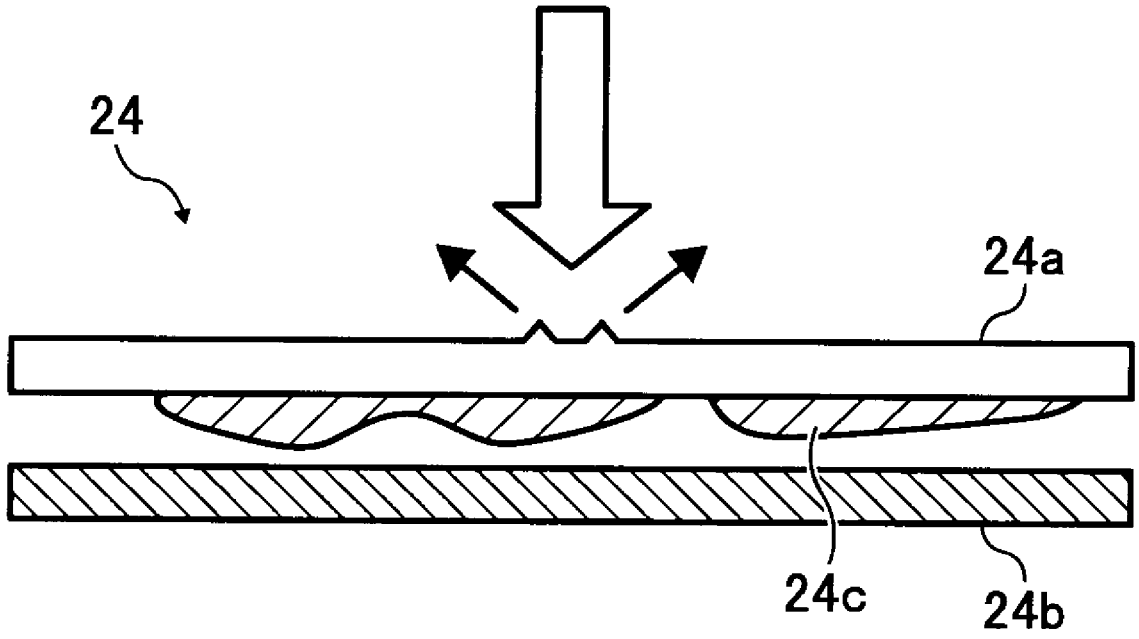
FIG. 2 is a schematic sectional view illustrating the information recording medium according to the exemplary embodiment of the present invention in a reverse state.

FIG. 2 is a sectional view illustrating an information recording medium 24 according to the exemplary embodiment of the present invention in a reverse state.

The information recording medium 24 includes a transparent member 24*a* acting as the transfer sheet P of FIG. 1 and a non-transparent member 24*b*. The transparent member 24*a* includes a reverse toner image 24*c* affixed thereto. The non-transparent member 24*b* is not limited thereto and can be an a translucent member, an opaque member, etc.

The transparent member 24*a* of the information recording medium 24 may be partially transparent, substantially half transparent and half non-transparent, or entirely transparent. In addition, the transparent member 24*a* has a fine concavo-convex pattern, not shown, on a first surface thereof. The concavo-convex pattern is described later.

In the course of image formation by the image forming apparatus 20 of FIG. 1, the reverse toner image 24*c* is transferred onto the transparent member 24*a* of the information recording medium 24. Specifically, the fixing unit 7 of FIG. 1 fixes the reverse toner image 24*c* on the transparent member 24*a*. Subsequently, the transparent member 24*a* is conveyed to the post-processing device 25 of the image forming apparatus 20 in a direction indicated by an arrow C shown in FIG. 1.

The post-processing device 25 affixes the non-transparent member 24*b* to a second surface of the transparent member 24*a* having the reverse toner image 24*c* thereon. The post-processing device 25 can perform white spray coating and roller coating to form the non-transparent member 24*b*. Specifically, in the spay coating, for example, a liquid is sprayed on the second surface of the transparent member 24*a*, and followed by drying to form the non-transparent member 24*b*. Therefore, the information recording medium 24 can be observed as similar to a printed image made on a commonly used sheet.

The fine concavo-convex pattern on the first surface of the transparent member 24*a* is formed beforehand so that a difference in light reflection generated by the concavo-convex pattern can be identified when observing the transparent member 24*a*. The light reflection, for example, is represented by a thick arrow and thin arrows shown in FIG. 2. The concavo-convex pattern on the transparent member 24*a* is irreproducible when a duplicate is made using a scanner, thereby enabling easy identification of the duplicate.

The concavo-convex pattern can be formed by pressing against a mold after a transparent medium is formed into a film, for example, the transparent member 24*a*. The concavo-convex pattern can also be formed by a replica method in which a transparent medium in a liquid state and a semisolid state is placed in the mold in the course of forming the film.

The image forming apparatus 20 mirrors the image information therewithin, thereby saving a pre-processing labor of the image.

The transparent member 24*a* of the information recording medium 24 can include an ultraviolet absorbent such as salicylate, benzophenone, benzotriazole, and cyanoacrylate to prevent discoloration and color fading of the image caused by ultraviolet rays.

As can be appreciated by those skilled in the art, numerous additional modifications and variations of the present invention are possible in light of the above-described teachings. It is therefore to be understood that, within the scope of the appended claims, the disclosure of this patent specification may be practiced otherwise than as specifically described herein.

What is claimed is:

1. A method of preparing an information recording medium, comprising the steps of:

forming a reverse toner image on a second surface of a transparent recording member having at least one transparent area and a concavo-convex pattern on a first surface thereof;

fixing the reverse toner image on the second surface of the transparent recording member; and forming a non-transparent member on the second surface of the transparent recording member, wherein the step of forming a non-transparent member includes:

coating the second surface of the transparent recording member with a non transparent liquid; and drying the non-transparent liquid.

2. The method according to claim 1, further comprising:

mirroring image information to prepare a reverse toner image.

* * * * *